US006799555B2

(12) United States Patent
Luithardt et al.

(10) Patent No.: US 6,799,555 B2
(45) Date of Patent: Oct. 5, 2004

(54) ADJUSTING DEVICE FOR A THROTTLE PULL OF AN INTERNAL COMBUSTION ENGINE

(75) Inventors: Wolfgang Luithardt, Waiblingen (DE); Maximilian Eberhardt, Esslingen (DE); Markus Hüsges, Bad Wiessee (DE); Christian Ante, Unna (DE); Jens Heine, Wörth am Rhein (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/987,767

(22) Filed: Nov. 15, 2001

(65) Prior Publication Data

US 2004/0040539 A1 Mar. 4, 2004

(30) Foreign Application Priority Data

Nov. 15, 2000 (DE) ..... 100 56 714

(51) Int. Cl.[7] ..... F02D 11/04
(52) U.S. Cl. ..... 123/400
(58) Field of Search ..... 123/400, 337

(56) References Cited

U.S. PATENT DOCUMENTS 5,718,052 A * 2/1998 Taomo et al. ..... 123/398
5,868,377 A * 2/1999 Taomo et al. ..... 123/400
6,178,948 B1 * 1/2001 Garrick et al. ..... 123/400
2002/0088431 A1 * 7/2002 Dahlberg et al. ..... 12/400
2004/0079328 A1 * 4/2004 Sterr ..... 123/400

* cited by examiner

*Primary Examiner*—Erick Solis
(74) *Attorney, Agent, or Firm*—Walter Ottesen

(57) ABSTRACT

The invention is directed to an adjusting device for a throttle pull of an internal combustion engine for a portable hand-held work apparatus. A pull wire (11) of the throttle pull acts on the carburetor (4) of the engine. The carburetor (4) is attached to the inlet of the engine with a spacer (6) disposed therebetween. A tension piece (5) of the adjusting device is pivotally journalled on the spacer (6) by a bolt. The pull wire (11) lies with a segment thereof on the outwardly pivotable arm of the tension piece (5). The position of the tension piece can be adjusted with the adjusting screw (14). The adjusting screw can be screwed out of the pivot arm axially in the direction toward a support. The tension piece (5) is configured as one piece with the bolt (12) and is securely held with a form-tight holding arrangement in the axial direction of the bolt (12). The adjusting device is cost-effective and provides for a reliable and precise adjustment.

13 Claims, 5 Drawing Sheets

ADJUSTING DEVICE FOR A THROTTLE PULL OF AN INTERNAL COMBUSTION ENGINE

BACKGROUND OF THE INVENTION

In handheld portable work apparatus, the tool is driven by an internal combustion engine to which a mixture, which is to be combusted, is supplied by a carburetor. The power output of the internal combustion engine is adjustable via a throttle pull. The throttle pull has a pull wire which is connected to an actuating element which, in most cases, is the throttle flap of the carburetor. The carburetor is fixed to the inlet of the engine with a spacer interposed therebetween in order to make possible a compact contour of the housing of the engine and to counter an unwanted influencing of the temperature of the carburetor by the heat of the engine. The pull wire is guided via an adjusting device in order to adjust the effective length of the pull line and therefore the idle position and full-load position of the carburetor. The adjusting device comprises a pivotably journalled tension piece. The tension piece is journalled with a bolt which is provided with a spring nut for securely holding the same. This assembly movement can be automated only with difficulty and is therefore still carried out manually and therefore is time intensive. Furthermore, it has been shown time and again during the operation of work apparatus, which are equipped with such a throttle pull guide, that a precise adjustment of idle is only possible with a corresponding expenditure of time. The adjusting device is further subjected to considerable vibrations of the engine which ultimately can affect the adjustment of the length of the pull wire.

SUMMARY OF THE INVENTION

It is an object of the invention to provide an adjusting device for a throttle pull of an internal combustion engine which is easily assembled.

The adjusting device of the invention is for a throttle pull of an internal combustion engine including an engine of a portable handheld work apparatus. The engine includes a carburetor having an actuating member and the throttle pull includes a pull wire connected to the actuating member. The adjusting device includes: a spacer; the carburetor being connected to the inlet of the engine with the spacer being disposed therebetween; a support; a tension piece having a pivotable arm on which a segment of the pull wire lies and the tension piece holding the segment by being in contact engagement with the support; a bolt for pivotally journalling the tension piece on the spacer; an adjusting screw threadably engaged in the pivot arm for adjusting the position of the tension piece; the adjusting screw being disposed radially of the bolt and being screwable out of the pivot arm in a direction toward the support; the tension piece and the bolt being configured as a single piece; the bolt defining a longitudinal axis; and, means for securely holding the tension piece in the direction of the longitudinal axis.

The adjusting device is provided with a tension piece which is pivotably journalled on the spacer by means of a bolt formed thereon as one piece. A segment of the pull wire lies on the pivotable arm of the tension piece. The pull wire holds the tension piece in contact engagement on a support. The effective length of the pull wire is adjustable with an adjusting screw. The adjusting screw lies at a radial spacing from the bolt and can be screwed axially out of the pivot arm in a direction toward the support.

A common component can be assembled onto the spacer because of the one-piece configuration of the tension piece with the bolt. According to the invention, the common component is held in the axial direction of the bolt by a form-tight connection. In this way, only one component has to be attached to the spacer during assembly and the complex axial attachment which was required previously is unnecessary.

A practical form-tight holding of the tension piece to the spacer is provided by a key which projects radially from the bolt. The bearing eye of the spacer is provided with a through cut or opening which has a cross section corresponding to the key. The key forms a bayonet latch with the bearing eye in the built-in position of the tension piece with an angular offset. The key on the bolt and the through opening on the spacer are provided at such an angular position relative to each other that the bolt can be pushed into the bearing eye in an angular position during assembly of the tension piece and this angular position lies outside of the angular pivot range of the tension piece which can be adjusted with the adjusting screw. The key can then lie approximately perpendicular to the axis of the adjusting screw. For an angular offset of the key relative to the through opening of approximately 10° to 120° (preferably approximately 90°), the tension piece can be seated in a position lying far outside of the adjustable angular pivot range and can be brought into the assembled position with a rotation during the assembly of the tension piece. The key engages behind the bearing eye of the spacer and ensures the axial form-tight holding thereof.

Preferably, the tension piece is pivotally movably mounted between the respective mutually adjacent sides of the carburetor and the spacer with axial guide play in the axial direction of the bolt. The carburetor itself can serve also as a single measure for axial form-tightly holding the tension piece. The tension piece is held in every adjustable position and is secured against the vibrations of the engine. On the side facing toward the spacer, the tension piece is guided on a surface which is formed on the spacer in the vicinity of the bearing eye for the bolt. An advantageous guidance on the side of the spacer facing toward the carburetor is advantageously formed by a support channel configured on the spacer in which a support projection is guided. The support projection projects radially from the tension piece. The support projection is preferably arranged on the support side of the tension piece at the elevation of the bolt and lies on the support channel of the spacer when in the assembled condition. The support side of the spacer has the adjusting screw. The support projection has a radial contour curved about the bolt axis so that in every adjustable tension position of the tension piece, a support is provided and, in this way, only reduced shearing forces develop in the bolt. With an adjustment of the tension piece, the support projection rolls on the support channel. In the tensioned condition of the throttle pull, the occurring transverse forces are carried exclusively by the support projection and the bolt is held free of shear forces and therefore only has a guide function for the pivot movement.

In another embodiment of the invention, a guide wall is formed on the support channel and radially overlaps the support projection of the tension piece. The guide wall holds the support projection, and therefore the tension piece, in axial direction. The guide wall and the support projection lie essentially parallel to each other advantageously with guide play in the axial direction of the bolt whereby also an axial guidance is given on the side of the spacer facing toward the carburetor.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
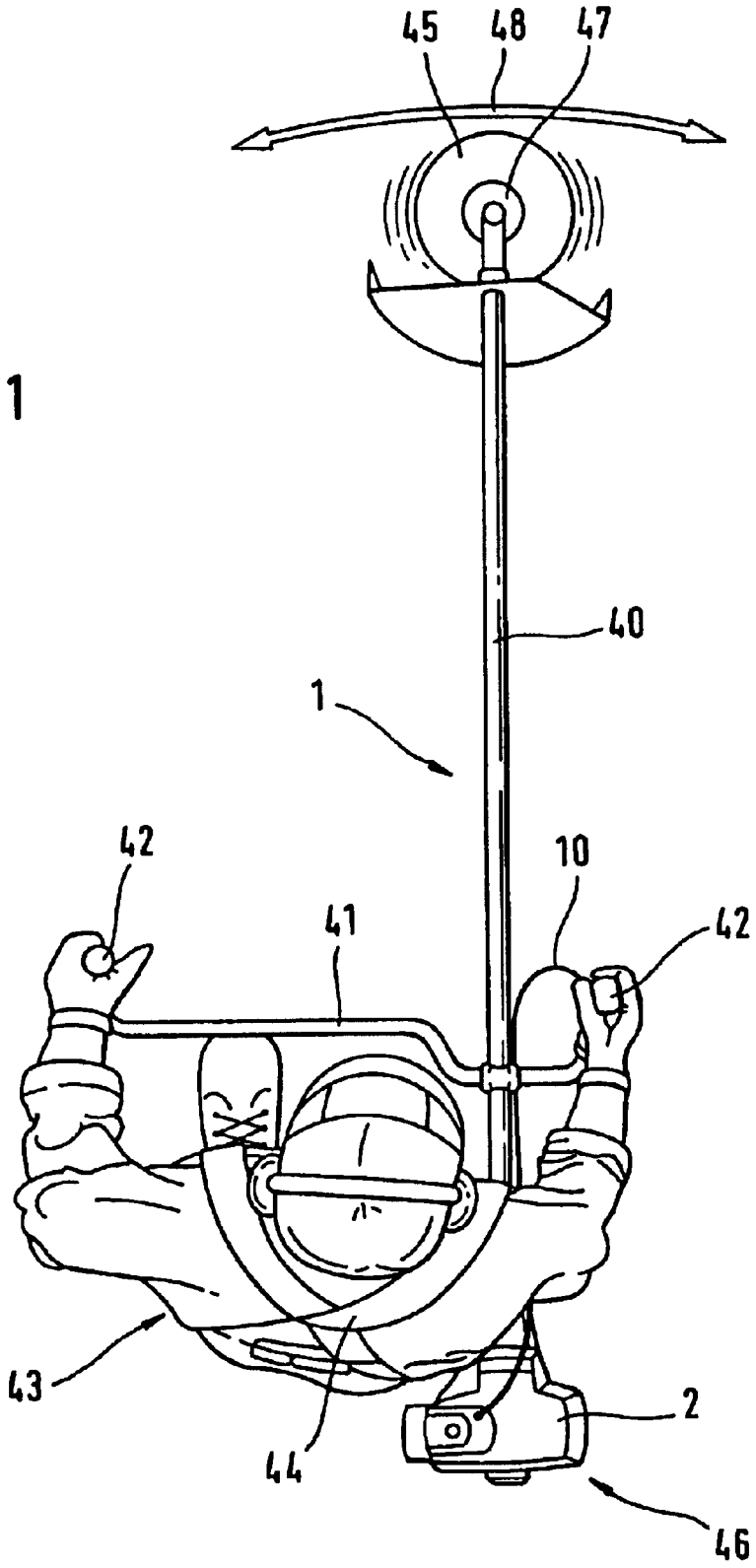
FIG. 1 is a plan view showing a brushcutter guided by an operator.

The handheld work apparatus shown in FIG. 1 is a brushcutter 1 for cutting grass, brush or the like. A handle bar 41 for guiding the brushcutter is attached to a guide wand 40 of the brushcutter 1. The handle bar 41 has handles 42 at its free ends which are grasped by an operator 43 for guiding the brushcutter 1. The operator 43 carries the brushcutter 1 via a carrying belt 44.

A drive unit 2 is mounted at the rearward end 46 of the guide wand 40. The drive unit 2 comprises essentially an internal combustion engine 3 (FIGS. 2 and 3) mounted in a housing 28. The engine 3 drives a work tool 45 at the forward end 47 of the guide wand 40 via a drive shaft journalled in the guide wand. In the present embodiment, the work tool 45 is a rotating knife blade and is guided by the operator 43 in the arrow direction 48 back and forth over the surface to be cut. The handling of the brushcutter takes place via the handles 42. The drive power of the engine can be adjusted at the handle 42 via a throttle pull 10. The throttle pull 10 is a Bowden cable which is guided into the drive unit 2 and whose pull wire in the interior of the cable is connected to a carburetor 4 (FIG. 3) allocated to the engine 3.

Figure 2:
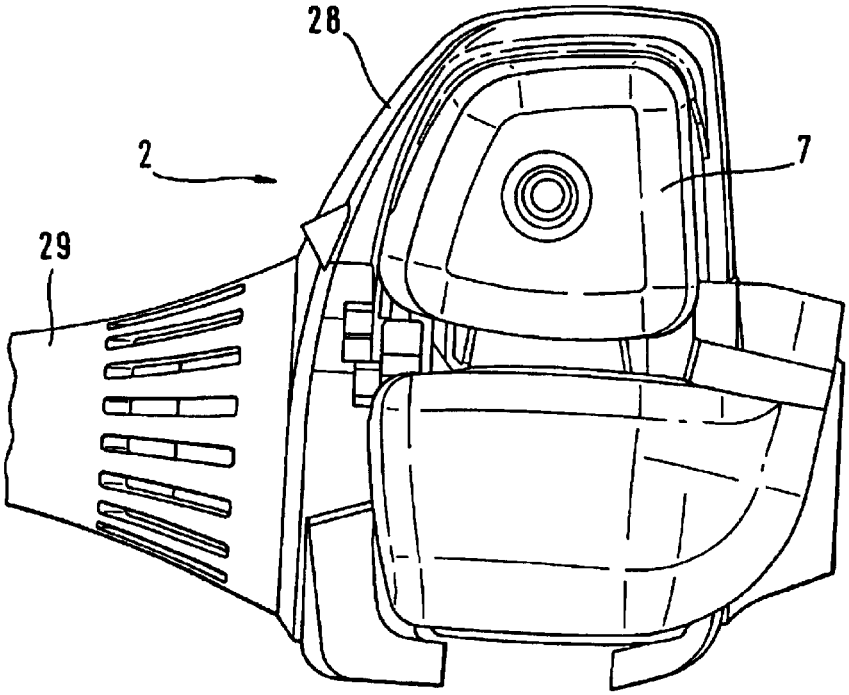
FIG. 2 is a side elevation view of the drive unit of the brushcutter.
Figure 3:
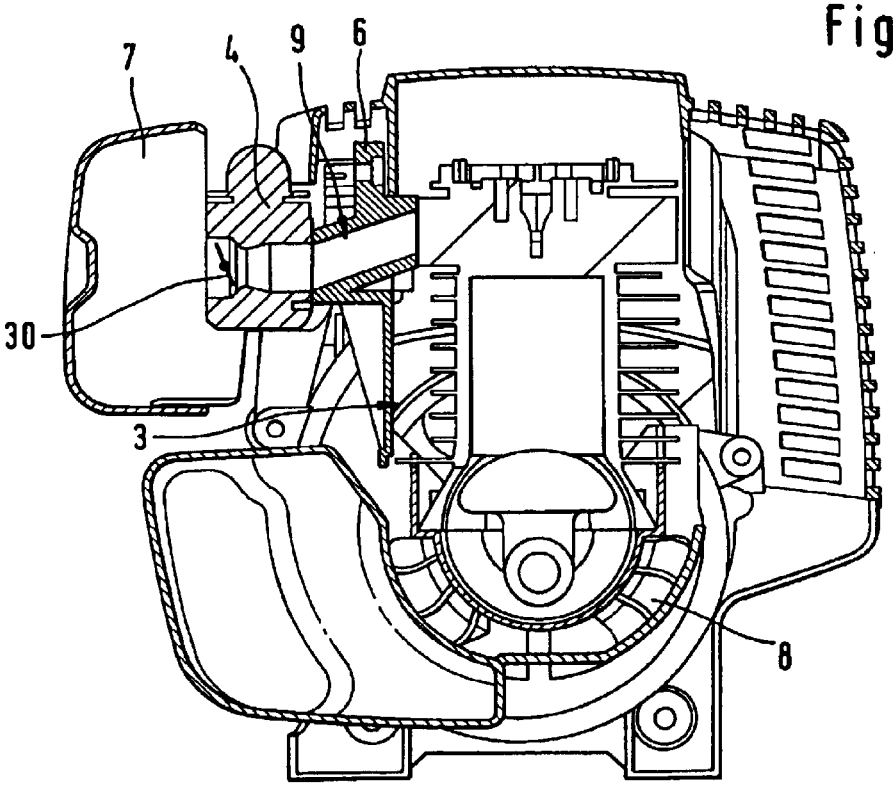
FIG. 3 is a longitudinal section view of the drive unit of FIG. 2.
Figure 4:
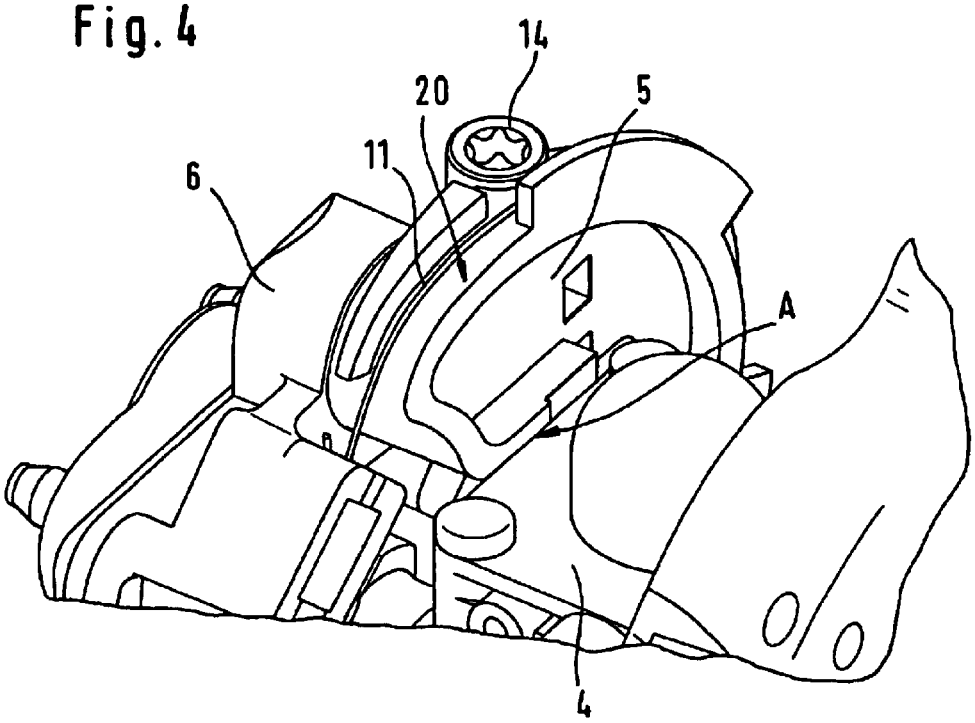
FIG. 4 is a perspective view of a tension piece for the throttle pull.
Figure 5:
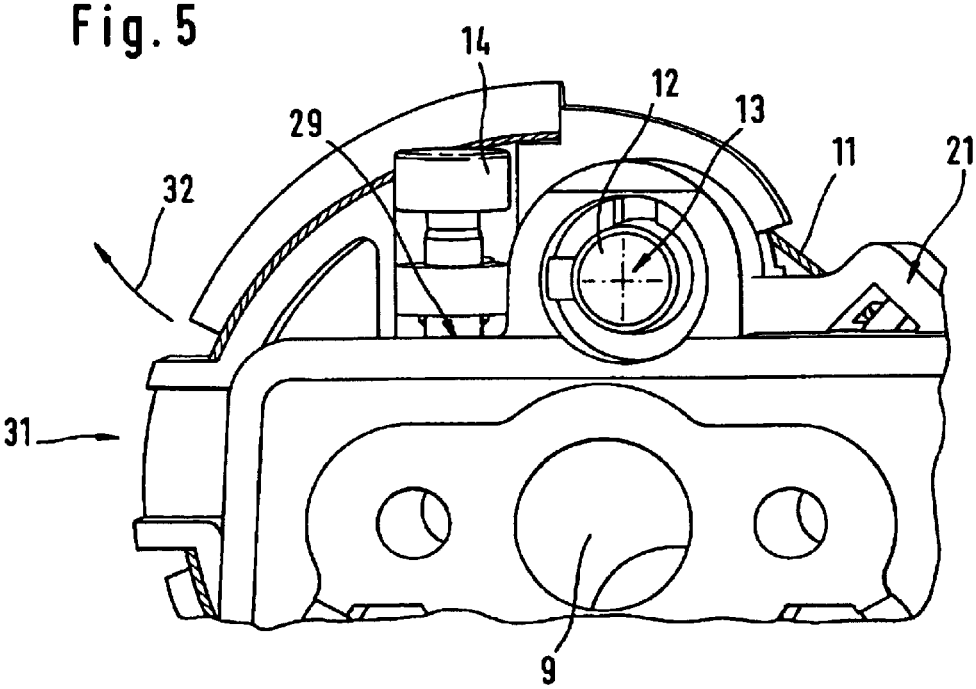
FIG. 5 is a side elevation view of the tension piece of FIG. 4.

The drive unit 2 according to FIGS. 2 and 3 includes a housing 28 in which an engine 3 is mounted in a compact configuration with the associated ancillary devices. In the present embodiment, the engine 3 is air cooled and the cooling air is moved by a blower 8 driven by the engine 3. The guide wand 40 (FIG. 1) is connected via an output stub 29 to the housing 28 of the drive unit 2.

The carburetor 4 is connected to the inlet of the engine with a spacer 6 interposed therebetween. The spacer 6 holds the carburetor 4 at a distance from the engine and shields the carburetor against disadvantageous heat. The spacer 6 is also stroked by the cooling air flow of the blower 8. The spacer 6 has two essentially parallel flanges. One of the flanges is connected to the engine block and the carburetor 4 is attached to the other flange. A mixture channel 9 is formed in the spacer 6 through which the air/fuel mixture, which is prepared by the carburetor 4, is conducted to the engine. The mixture channel 9 is configured inclined to the planes of the flanges and makes possible a compact arrangement of the apparatus in the engine housing. The combustion air is conducted to the carburetor 4 through an air filter 7. The power output of the engine 3 is adjusted by a throttle flap 30 in the air channel of the carburetor 4. The position of the throttle flap 30 can be influenced by the throttle pull 10. The throttle flap 30 is provided with a reset device which brings about a return positioning of the throttle flap 30 and therefore a reduction of the drive power of the engine 3 when there is no pull force on the throttle pull 10.

The operability of the throttle pull is guaranteed by an adjusting device for the throttle pull and this adjusting device is explained in greater detail with respect to FIGS. 4 to 9.

Figure 6:
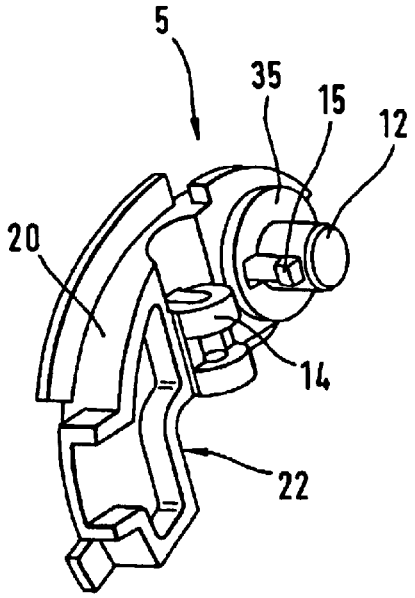
FIG. 6 is a perspective view of a tension piece.
Figure 7:
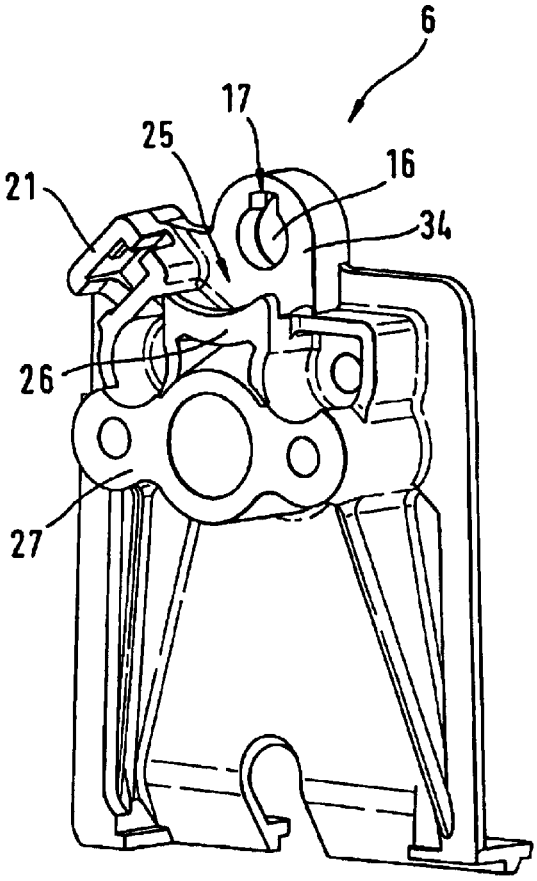
FIG. 7 is a perspective view of a spacer.
Figure 8:
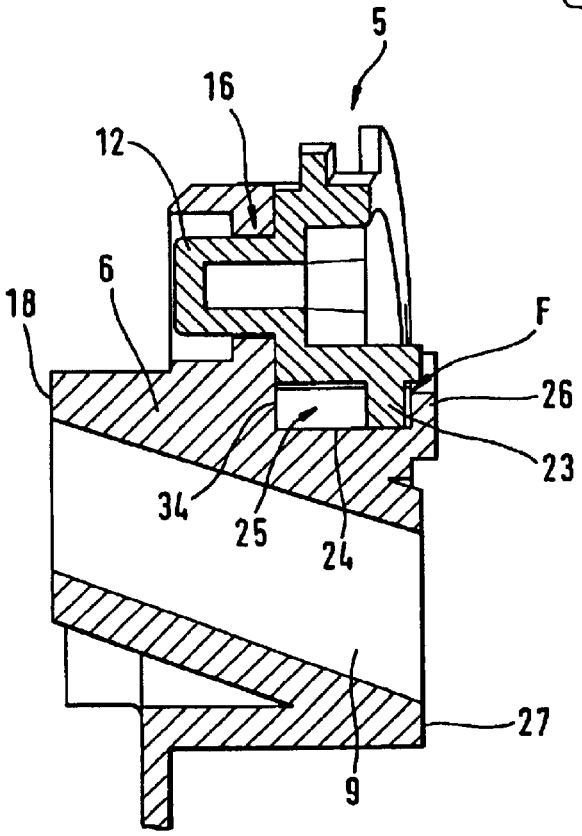
FIG. 8 is a section view of a tension piece shown assembled on the spacer; and, FIG. 9 is a side elevation view of a tension piece.
Figure 9:
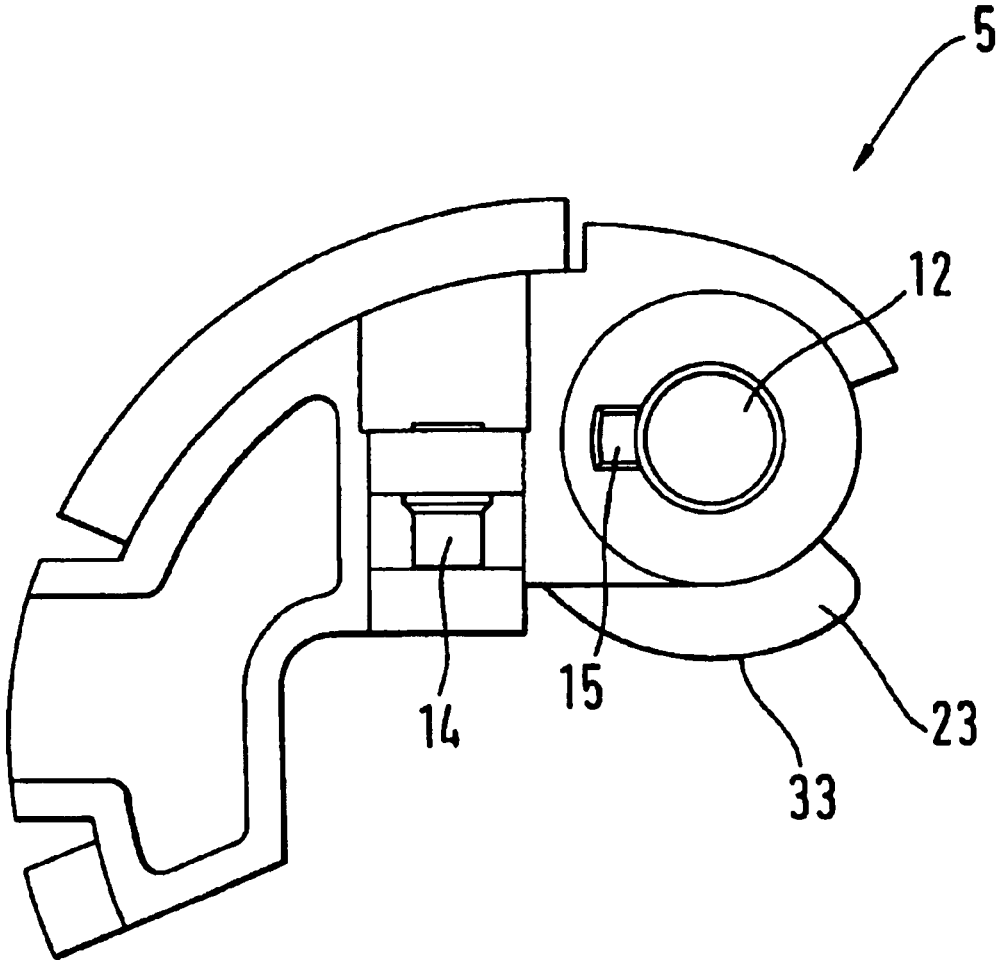

The effective length of the throttle pull can be adjusted by a tension piece 5 which is journalled to be pivotally movable on the spacer 6. The tension piece 5 is shown in FIGS. 6 and 9 as an individual piece and is pivotally mounted with a bolt 12 in a bearing eye 16 of the spacer 6 (FIG. 7). The tension piece is configured with an arcuately-shaped lever arm 31. A wire guide 20 is provided on the outer-lying side of the lever arm 31 and the pull wire 11 of the throttle pull lies on the guide 20 with an arcuately-shaped course when mounted. As shown especially in FIG. 5, the wire 11 of the throttle pull is axially supported in a wire socket 21 and the axially movable pull wire 11 is guided over the tension piece 5 to the carburetor in order to transmit wanted control pulses to the throttle flap of the carburetor. The pull wire 11 holds the tension piece with its lever arm 31 in contact engagement on the spacer 6.

The effective length of the pull wire or tension in the pull wire 11 is adjustable with an adjusting screw 14. The adjusting screw 14 can be screwed radially out of the lower side of the tension piece axially in a direction toward a support 29. It is the lower side of the tension piece which is supported. In the present embodiment, the support surface 29 is provided on the spacer 6. The adjusting screw 14 lies at a spacing radially from the bolt 12. A torque about the axis 13 of the bolt 12 is brought about by rotational movements of the adjusting screw 14 by the reaction force of the support 29. With the pivot movement of the pivot arm 31 of the tension piece in the direction of arrow 32, the effective length of the throttle pull is precisely adjustable in correspondence to the rotations of the adjusting screw 14.

The tension piece 5 is axially form tight secured and is journalled so as to be pivotally movable in order to ensure a precise adjustability of the pull wire. The tension piece 5 is pivotally movably mounted for this purpose with axial guide play A (FIG. 4) between the carburetor 4 and the spacer 6. An axial holding of the tension piece 5 or the pivot arm can take place via the carburetor alone. An advantageous journalling which avoids disturbing axial movements and is easily mountable is provided by the one-piece configuration of the tension piece with the bolt 12. The form-tight axial holding is provided on the bolt 12. The tension piece 5 is preferably made of plastic, for example, as an injected-molded part. During assembly of the tension piece, the bolt 12 is inserted through the bearing eye 16 (FIGS. 7 and 8) of the spacer 6. The bearing eye 16 is provided in a planar guide surface 34 on the spacer 6 on which surface a corresponding pedestal surface 35 at the foot of the bolt 12 lies in contact engagement in the assembled position of the tension piece 5.

A lug or key 15 is formed on the bolt 12 of the tension piece 5 to provide a form-tight axial hold. The key 15 projects radially and is guided through a through slot 17 of the bearing eye 16 of the spacer 6. The through slot 17 has a cross section corresponding to the key 15 so that the key 15, which is inserted through the bearing eye, forms a bayonet lock with the spacer 6 in the assembled position of the tension piece 5. For this purpose, the key 15 and the through slot 17 are provided at such an angular position relative to each other which lies outside of the possible positions of the tension piece in the pivot angular range adjustable with the adjusting screw. In this way, a single component is inserted into the spacer 6 during assembly of the tension piece 5 whereby the assembly and also the disassembly for the purpose of maintenance is facilitated. The tension piece 5 is mountable in only such a position which lies outside of the position provided for adjusting the throttle pull during operation. An unwanted separation of the tension piece from its bearing is thereby prevented. The key then lies at an angular position disposed perpendicularly to the axis of the adjusting screw.

The spacer 6 can be assembled as a component of the adjusting device as a common assembly group with the tension piece 5. In separate work steps, the spacer 6 can be placed with its flange surface 18 (FIG. 8) on the engine block. Correspondingly, the carburetor is attached to the opposite-lying flange surface 27 of the spacer.

A further stabilization of the assembled position of the tension piece is given by the configuration of a radially projecting support projection 23 on the tension piece 5. The tension piece 5 is supported in the assembled condition on the spacer 6. As FIG. 9 shows in the side elevation view of the tension piece 5, the support projection 23 is provided at about the elevation of the bolt 12 on the lower side which is to be supported. The adjusting screw can also be screwed out of this lower side. The support projection 23 has a contour 33 which is configured to be arcuate and is at least partially concentric to the axis of the bolt 12. In this way, for each possible pivot position of the tension piece 5, a support is provided by the support projection 23. The transverse forces, which are applied by the pull wire to the tension piece 5, are guided from the support projection 23 into the spacer 6 in accordance with the invention and, in this way, the bolt 12 is relieved of load.

In addition to the support function of the bolt 12, the support projection 23 contributes to the form-tight stabilization of the tension piece 5 and to the guidance of the pivot movement because the roll-off surface 24 is provided in a support channel 25 of the spacer. The support channel 25 lies on the side of the spacer 6 facing toward the carburetor. The guidance of the pivot piece is provided by a guide wall 26 which delimits the roll-off surface 24 in the axial direction of the bolt and overlaps the support projection 23 in the radial direction. The inner side of the guide wall 26 and the support projection 23 are disposed parallel to each other with guide play. The guide play F corresponds to the excess of the spacing of the guide wall 26 to the parallel guide surface 34 in the vicinity of the bearing eye 16 relative to the axial dimension between the bolt pedestal surface 35 and the support projection 23 of the tension piece 5.

It is understood that the foregoing description is that of the preferred embodiments of the invention and that various changes and modifications may be made thereto without departing from the spirit and scope of the invention as defined in the appended claims.

What is claimed is:

1. An adjusting device for a throttle pull of an internal combustion engine including an engine of a portable hand-held work apparatus, the engine including a carburetor having an actuating member and the throttle pull including a pull wire connected to said actuating member, the adjusting device comprising:

a spacer;

said carburetor being connected to the inlet of said engine with said spacer being disposed therebetween;

a support;

a tension piece having a pivotable arm on which a segment of said pull wire lies and said tension piece holding said segment by being in contact engagement with said support;

a bolt for pivotally journalling said tension piece on said spacer;

an adjusting screw threadably engaged in said pivot arm for adjusting the position of said tension piece;

said adjusting screw being disposed radially of said bolt and being screwable out of said pivot arm in a direction toward said support;

said tension piece and said bolt being configured as a single piece;

said bolt defining a longitudinal axis; and, means for securely holding said tension piece in the direction of said longitudinal axis.

2. The adjusting device of claim 1, wherein said spacer has a bearing eye formed therein for receiving said bolt; said bolt has a radially extending key formed thereon; said bearing eye includes a through cut formed thereon having a cross section corresponding to said key; and, said key and said through cut are offset at such an angular position that they conjointly define a bayonet latch when said tension piece is in the built-in position.

3. The adjusting device of claim 2, wherein said tension piece is movable through an adjustable pivot angular range by adjusting said adjusting screw; and, said key and said through cut are at a rotational angular offset relative to said built-in position so that said tension piece is insertable into said bearing eye at an assembly rotational angle which lies outside of said pivot angular range.

4. The adjusting device of claim 3, wherein said adjusting screw defines an axis and said key is disposed at a rotational angle position lying approximately perpendicular to said axis.

5. The adjusting device of claim 4, wherein said key is at a rotational angular offset relative to said through cut of between 10° to 12° when said tension piece is in said built-in position thereof.

6. The adjusting device of claim 5, wherein said rotational angular offset is approximately 90°.

7. The adjusting device of claim 1, wherein said carburetor and said spacer have respective mutually adjacent sides; and, said tension piece is pivotally movably mounted between said mutually adjacent sides with an axial guide play (F) in the direction of said longitudinal axis of said bolt.

8. The adjusting device of claim 1, wherein said tension piece has a support side from which said adjusting screw extends and a radially-configured blade-like supporting projection extending downwardly from said support side for supporting said tension piece; said supporting projection is at the elevation of said bolt; and, said supporting projection has a radial contour curved about said longitudinal axis of said bolt.

9. The adjusting device of claim 8, wherein said tension piece is supportable on said spacer.

10. The adjusting device of claim 9, wherein said spacer has a support channel formed thereon on which said supporting projection seats.

11. The adjusting device of claim 10, wherein a guide wall is formed on said spacer to delimit one side of said support channel; and, said guide wall radially overlaps said supporting projection.

12. The adjusting device of claim 11, wherein said guide wall and said supporting projection lie essentially parallel to each other with said axial guide play (F) in the direction of said longitudinal axis of said bolt.

13. The adjusting device of claim 1, wherein said spacer has a bearing eye formed therein for receiving said bolt; and, said bolt is seated in said bearing eye from the side of said carburetor and is axially held by said carburetor when mounted.

* * * * *